US005988415A

United States Patent [19]

White

[11] Patent Number: 5,988,415

[45] Date of Patent: Nov. 23, 1999

[54] BOTTLE FLOW CONTROLLER

[75] Inventor: Keith T. White, Danville, Calif.

[73] Assignee: Paul and Sara Garbarini 1989 Family Trust, Tiburon, Calif.

[21] Appl. No.: 08/200,420

[22] Filed: Feb. 23, 1994

[51] Int. Cl.[6] ..... B65D 39/06

[52] U.S. Cl. ..... 215/266; 215/312; 1471/320; 1471/321; 222/547; 222/564

[58] Field of Search ..... 215/264, 266, 215/270, 312; 141/320, 321; 222/547, 564

[56] References Cited

U.S. PATENT DOCUMENTS

| | | | |
|---|---|---|---|
| 175,952 | 4/1876 | Edwards | 215/266 |
| 323,737 | 8/1885 | Roorbach . | |
| 355,642 | 1/1887 | De Quillfeldt | 215/312 X |
| 357,909 | 2/1887 | De Quillfeldt | 215/266 |
| 365,961 | 7/1887 | Beardsley . | |
| 376,916 | 1/1888 | Rylands | 215/266 |
| 560,444 | 5/1896 | Temple . | |
| 1,079,403 | 11/1913 | Crecelius . | |
| 2,584,183 | 2/1952 | Blumauer | 215/312 X |
| 4,125,200 | 11/1978 | Manley | 215/246 |
| 4,741,448 | 5/1988 | Alley et al. | 215/266 |

FOREIGN PATENT DOCUMENTS

| | | | |
|---|---|---|---|
| 2294919 | 8/1976 | France . | |
| 181834 | 3/1907 | Germany | 215/312 |
| 292672 | 4/1914 | Germany | 215/312 |
| 1485 | of 1872 | United Kingdom . | |
| 370048 | 4/1932 | United Kingdom | 215/312 |

*Primary Examiner*—Stephen K. Cronin
*Attorney, Agent, or Firm*—Theodore J. Bielen, Jr.

[57] ABSTRACT

A device for controlling the flow of liquid from a bottle having a chamber and a spout with a passage communicating with such chamber. A cage is partially located within the bottle at the spout passage. The cage defines a particular volume and includes an exit communicating with the spout passage. A floating element is located and moveable within the cage. The floating element is formed to block the spout passage from the bottle when it is positioned adjacent the spout passage. The floating element also permits the flow of fluid from the passage when the bottle is oriented in a certain configuration. The cage may be secured to the spout passage or formed integrally with the spout.

6 Claims, 2 Drawing Sheets

FIG. 1
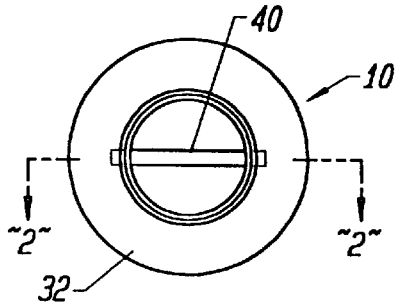
FIG. 2
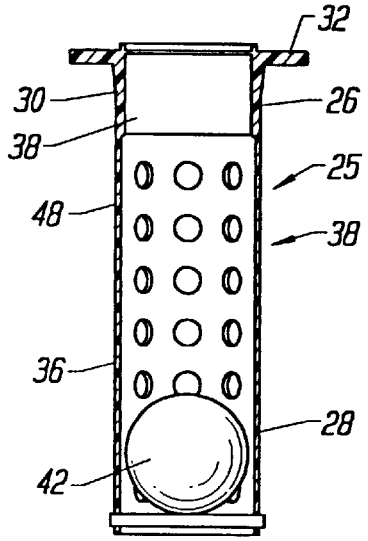
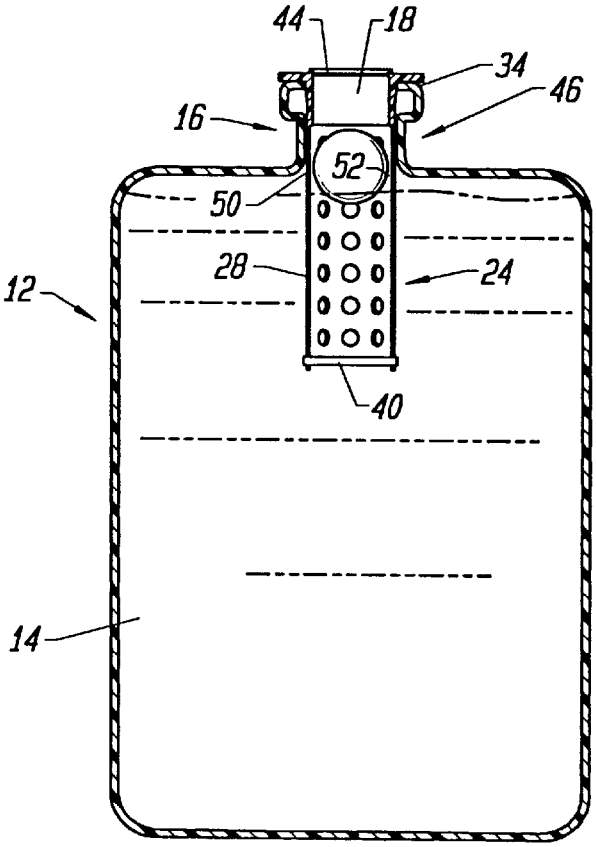
FIG. 3

BOTTLE FLOW CONTROLLER

BACKGROUND OF THE INVENTION

The present invention relates to a novel and useful device for controlling the flow of liquid from a bottle.

The present application is a substitute for my prior filed application Ser. No. 07/983,874, Filed Dec. 1, 1992, now abandoned.

Bottled water may be purchased in small quantities or in large five (5) gallon bottles. In the latter case, the water is normally delivered to the desired point of distribution, be it at a home, office, or the like. Bottles of this nature are normally sealed and used in conjunction with a water dispensing apparatus which may cool or heat the water prior to use. To position the water bottle on the water bottle dispenser, the user must unseal the bottle, lift the bottle, and invert the same into the opening at the top of the dispenser. Unfortunately, this maneuver requires a fair degree of strength and a large degree of agility to avoid spilling the water from the water bottle, especially when the bottle is inverted to a certain degree. Spilled water has a tendency to damage walls, carpets, and items around the water dispenser. In addition, wet areas near the water dispenser are subject to mildewing. Further, the user in hurrying to invert the bottle, may incur physical injury.

In this regard, U.S. Pat. Nos. 4,741,448, 4,125,200, 1,079, 403, 560,444, 323,737, 365,961, 357,909, British reference No. 1485, Vallet's British Specification 13,158, Ryland's British Specification 4246, and French reference 74 41575 describe bottles having free flowing resilient spheres for stopping passage of water through the bottle spout.

Further problems occur with used water bottles in that they are often misused later to carry dangerous materials such as organic solvents, oil, gasoline, and the like.

A device for controlling the flow of water from a water bottle and to prevent misuse of the bottle at a later time would be a notable advance in the field of foods and beverages.

SUMMARY OF THE INVENTION

In accordance with the present invention a novel and useful device for controlling the flow of liquid into and out of a bottle is herein provided.

The device of the present invention is useable with a bottle having a chamber and a spout with a passage for communicating with the chamber. A cage is located within the bottle at the spout passage. The cage would define volume within the bottle and possess an exit communicating with or forming a portion of the spout passage. The cage may be constructed as an insert or formed integrally with the bottle during its manufacture. The cage may be formed with a first portion locatable in the spout passage and a second portion extending toward the chamber of the bottle and for location within the chamber in certain cases. The second end portion of the cage may include a wall and a plurality of apertures through the wall. The first end portion of the cage may be of solid construction. An end bar or cap may also be constructed as a portion of the cage second portion.

Means is also included in the present invention for securing or supporting the cage to the bottle at the spout passage. Such securing means may externalize in a friction fit of the cage through the interior of the spout, by gluing, or sonic welding the cage to the spout, or forming the cage integrally with the spout of the bottle. Where a friction fit is employed as the securing means, a lip may be formed on the outer edge of the cage to stop movement of the cage beyond a certain point toward the chamber of the bottle.

The present invention also encompasses a floating element which is positioned and movable within the cage. The floating element is sized to prevent its travel through the spout passage formed by the original spout or the cage itself. In such a position, the floating element is capable of obstructing the flow of liquid from the bottle. The floating element is also capable of floating free of the spout passage when the bottle is oriented in a certain position. For example, the floating element may obstruct the flow of fluid from the bottle during the inversion process of the bottle. That is to say, when the spout of the bottle is tilted from the vertical position, obstruction would occur. Also, when the bottle is completely inverted such that the spout of the bottle orients downwardly, the floating element would float free of the passageway of the spout and yet remain in the cage. The cage is so formed to allow flow of liquid through the cage, and out the passageway of the bottle spout.

It may be apparent that a novel and useful device for controlling the flow of liquid from a bottle is herein described.

It is therefore an object of the present invention to provide a device for controlling the flow of liquid from a bottle which will allow an open bottle to be turned downwardly for a short period of time without spillage of any significant amount of liquid from the bottle and yet permit the flow of liquid from the bottle when the bottle is in an inverted position.

Another object of the present invention is to provide a device for controlling the flow of liquid which allows the user of the bottle to place the same in a liquid dispenser with a slow and smooth motion, to prevent injury to the person manipulating the bottles.

A further object of the present invention is to provide a device for controlling the flow of liquid from a bottle which prevents the growth of mildew around the liquid bottle dispenser used in conjunction with the bottle.

Yet another object of the present invention is to provide a device for controlling the flow of liquid from a bottle which includes an insert that is removable and reusable on bottles that have been cleaned and sanitized.

A further object of the present invention is to provide a device for controlling the flow of liquid from a bottle which will tend to prevent entry of foreign objects into a bottle containing potable liquid.

Another object of the present invention is to provide a device for controlling the flow of liquid from a bottle which includes an insert at the spout portion of the bottle that prevents later use of the bottle for toxic substances such as gasoline, motor oil, and the like.

The invention possesses other objects and advantages especially as concerns particular characteristics and features thereof which will become apparent as the specification continues.

BRIEF DESCRIPTION OF THE DRAWINGS

FIG. 1 is a top plan view of the present invention constructed as an insert.

FIG. 2 is a sectional view taken along line 2—2 of FIG. 1.

FIG. 3 is a sectional view of a bottle depicting the insert of FIGS. 1 and 2 installed therein.

Figure 4:
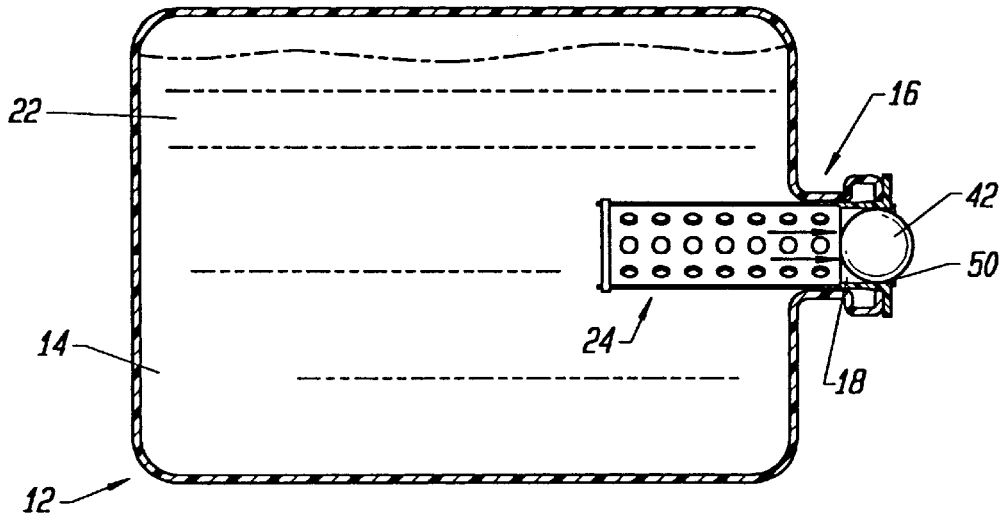
FIG. 4 is a sectional view of a bottle depicting the stoppage function of the device of the present invention when the spout portion of the bottle is substantially horizontal.

Reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be referenced to the herein before described drawings.

The invention as a whole is depicted in the drawings by reference character 10. The device 10 is intended for controlling the flow of liquid from a bottle 12 having a chamber 14 for containing liquid and a spout 16 forming a passageway 18 for the passage of liquid from chamber 14. Bottle 12 is typically used in conjunction with a liquid dispenser 20, shown partially in FIG. 5. Liquid body 22 within chamber 14 may be any potable liquid such as water, carbonated water, and the like.

Device 10 includes as one of its elements a cage 24 having a first portion 26 and a second portion 28. First portion 26 of cage 24 includes a wall 30 of varying thickness. Wall 30 terminates in a lip 32 which is intended to fit over the end 34 of spout 16. Lip 32 also permits bottle 12 to be sealed in a conventional manner (not shown).

Cage second portion 28 includes a wall 36 of generally cylindrical shape. Wall 36 possesses a plurality of apertures 25 which allow liquid to enter the interior space 38 defined by cage 24. Removable bar 40, FIG. 1, extends across wall 36.

A floating element 42 is placed within interior space 38 of cage 24. Floating element 42 is depicted in the drawings as a sphere which may be rigid or of a generally slightly resilient construction. That is to say, floating element 42 may be located within interior space 38 of cage 24 by removal of bar 40, yet is unable to leave cage 24 due to the replacement of bar 40 across wall 36 and the thickened wall portion 30 of first portion 26 of cage 24. In this regard, the end 44 of cage 24 may also be narrowed slightly to prevent the escape of floating element 42 from cage 24.

Means 46 is also employed for securing cage 24 to bottle 12. In the embodiment depicted in FIGS. 1–5, means 46 takes the form of friction fitting the outer surface 48 of cage 24 to the interior surface 50 of spout 16. Also, means 46 may simply externalize in a frictional engagement between outer surface 48 of cage 24 and lip 34. At this point, lip 34 serves as a stop to limit the travel of cage 24, and in particular second portion 28 into chamber 14 of bottle 12. It should be noted that other securing means embodiments may be employed such as gluing, sonic welding, and forming cage integrally with bottle 12. A portion of cage interior space 38 coincides with passageway 18 when cage 24 is in place as shown in the drawings.

Figure 5:
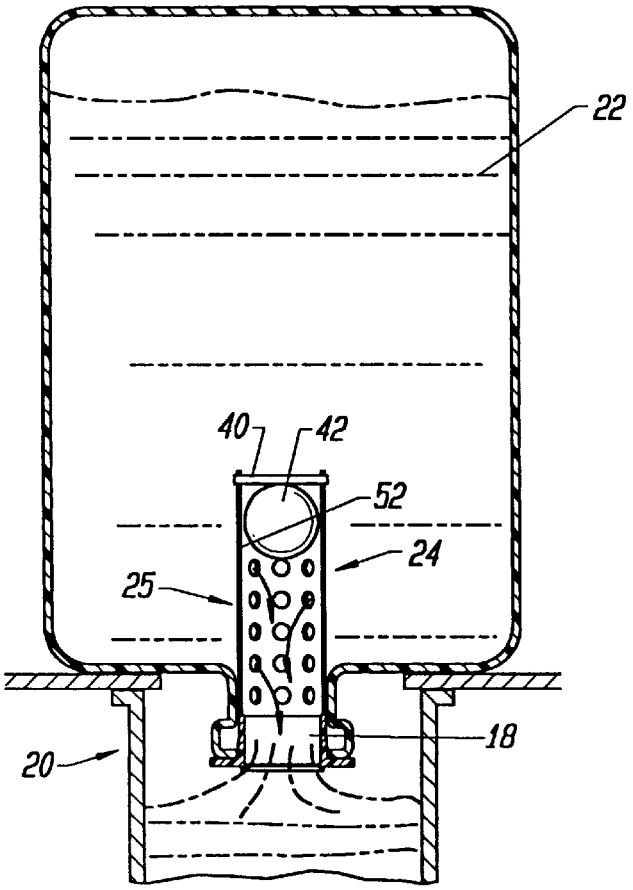
FIG. 5 is a sectional view of a bottle depicting the releasing function of the device of the present invention when the bottle is substantially in an inverted position.

In operation, turning now to FIGS. 4 and 5 it be may observed that bottle 12 may be moved from the upright position depicted in FIG. 3 to the completely inverted position shown in FIG. 5. FIG. 4 depicts bottle 12 between such positions where spout 16 is generally horizontal. At this point, body of liquid 22 forces floating element 42 into passageway 18 and sealing engagement with the interior surface 50 of spout 16 or interior surface 52 of cage 24. Thus, liquid body 22 is prevented from leaving chamber 14 of bottle 12 in this position. With further reference to FIG. 5, it is illustrated that floating element 42 leaves its position within passageway 18 of spout 16 and travels; upwardly against bar 40 within cage 24. While in the position depicted in FIG. 5, liquid body 22 may freely flow through plurality of apertures 25, through passageway 18, and into liquid dispenser 20. It has been found, that the maneuver of inverting of bottle 12 is more easily accomplished without injury to the user and without spillage of liquid from chamber 14 of bottle 12 during the process. In addition, device 10 serves as an obstruction to the refilling of bottle 12 with toxic materials such as gasoline.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A device for controlling the flow of liquid from a bottle having a chamber and a spout including a passage communicating with the chamber, comprising:

a. a cage located within the bottle at said spout passage, said cage enclosing a defined volume and including an exit, said cage exit communicating with the spout passage;

b. a floating element, said floating element being buoyant in the liquid, said floating element being located and movable within said cage, said floating element being formed to be unable to travel through said spout passage and being capable of obstructing the flow of liquid from the bottle when positioned adjacent the spout passage, said floating element being further capable of floating free of said spout passage when the bottle is oriented in a certain position; and c. securing means for supporting said cage to said bottle at said spout passage.

2. The device of claim 1 in which said cage includes a first portion locatable in the spout passage, a second portion extending toward the chamber of the bottle, and said securing means holds said first portion of said cage to the spout passage.

3. The device of claim 2 in which said cage second portion includes a transversely extending member to prevent escape of said floating element from said cage second portion.

4. The device of claim 2 in which said securing means comprises said first portion of said cage to wedge within the spout passageway.

5. The device of claim 2 in which said cage second portion includes a wall and further includes a plurality of apertures through said wall.

6. A device for controlling the flow of liquid from a bottle having a chamber and a spout including a passage communicating with the chamber, comprising:

a. a cage located within the bottle at said spout passage, said cage enclosing a defined volume and including an exit, said cage exit communicating with the spout passage, said cage including a wall extending from said spout into the chamber of the bottle, said cage wall including a plurality of apertures extending transversely through said wall;

b. a floating element, said floating element being buoyant in the liquid, said floating element being located and movable within said cage, said floating element being formed to be unable to travel through said spout passage and being capable of obstructing the flow of liquid from the bottle when positioned adjacent the spout passage, said floating element being further capable of floating free of said spout passage and said plurality of apertures when the bottle is oriented in a certain position; and c. securing means for supporting said cage to said bottle at said spout passage.

* * * * *